United States Patent [19]

Hillman

[11] Patent Number: 4,574,682

[45] Date of Patent: Mar. 11, 1986

[54] TORQUE ASSIST DEVICE FOR A MULTI-BARREL WEAPON

[75] Inventor: Charles E. Hillman, Burlington, Vt.

[73] Assignee: General Electric Company, Burlington, Vt.

[21] Appl. No.: 617,052

[22] Filed: Jun. 1, 1984

[51] Int. Cl.[4] ..... F41D 7/04; B64D 7/02

[52] U.S. Cl. ..... 89/12; 89/14.3

[58] Field of Search ..... 89/12, 14.2, 14.3, 14.4

[56] References Cited

U.S. PATENT DOCUMENTS 3,703,122 11/1972 Farrington et al. ..... 89/14.3
3,898,910 8/1975 Groff ..... 89/14.3
4,121,496 10/1978 Clayson ..... 89/14.3 X
4,398,445 8/1983 Ulrich ..... 89/14.3

*Primary Examiner*—David H. Brown
*Attorney, Agent, or Firm*—Bailin L. Kuch

[57] ABSTRACT

There is provided for a Gatling type gun, a muzzle brake torque assist device having a plurality of radial flow turbines, each centered on a respective gun barrel of the gun, each turbine for providing a respective pure torque centered on the respective barrel, and which torques translate into a summation torque centered on the longitudinal axis of the cluster of barrels without generating any lateral loads on the stationary portions of the gun.

6 Claims, 6 Drawing Figures

TORQUE ASSIST DEVICE FOR A MULTI-BARREL WEAPON

FIELD OF THE INVENTION

This invention relates to a supplemental gas drive and brake device for a Gatling type gun.

BACKGROUND OF THE INVENTION

Gatling type guns, having a plurality of gun barrels disposed in an annular row in a rotor for rotation in a housing, are well known, having been first disclosed in U.S. Pat. No. 36,836 issued Nov. 4, 1862 to R. J. Gatling. The early Gatling guns had manual crank drives. C. J. Ebbets in U.S. Pat. No. 550,262 issued Nov. 26, 1895, and W. E. Simpson in U.S. Pat. No. 598,822 issued Feb. 8, 1898, respectively disclose supplemental gas drives wherein gun gas is bled from a port in the side of each barrel to operate a ratchet drive for the rotor. The modern Gatling gun was first disclosed in U.S. Pat. No. 2,849,921 issued Sept. 2, 1958 to H. Otto which had an electric motor drive.

Muzzle brakes for single barrel guns are also well known and are shown, for example, in U.S. Pat. No. 1,994,458 issued Mar. 19, 1935 to G. M. Barnes; U.S. Pat. No. 2,457,802 issued Jan. 4, 1949 to A. Bauer; and U.S. Pat. No. 2,567,826 issued Sept. 11, 1951 to J. E. Prache.

Muzzle brake torque assist devices for Gatling guns are shown in U.S. Pat. No. 3,703,122 issued Nov. 21, 1972 to D. A. Farrington et al, and U.S. Pat. No. 3,898,910 issued Aug. 12, 1975 to R. T. Groff. These patents respectively disclose a single turbine having a single annular row of curved radial passageways. Since each of the plurality of gun barrels in the rotor respectively provides gas mainly to the adjacent portion or sector of radial passageways; there is a lateral load which must be reacted by the stationary structure at the radius of the turbine outlets to react the force generated at the turbine outlets. The diameter of the single turbine must be larger than the diameter of the annular row of gun barrels, since the outlets of the single turbine are disposed radially outwardly beyond the maximum radius of the row of barrels.

SUMMARY OF THE INVENTION

It is an object of this invention to provide for a Gatling gun a muzzle brake torque assist device without a lateral reaction force applied to the gun mount.

It is another object of this invention to provide for a Gatling gun a muzzle brake torque assist device whose diameter is no greater than the maximum diameter of the barrel cluster of the gun.

A feature of this invention is the provision for a Gatling gun of a muzzle brake torque assist device having a plurality of radial flow turbines, each centered on a respective gun barrel, each turbine for providing a respective pure torque centered on the respective barrel, and which torques translate into a summation torque centered on the longitudinal axis of the cluster of barrels without generating any lateral loads on the stationary portions of the gun.

BRIEF DESCRIPTION OF THE INVENTION

These and other objects, features and advantages of this invention will be apparent from the following specification thereof taken in conjunction with the accompanying drawing in which.

DESCRIPTION OF THE INVENTION

Figure 1:
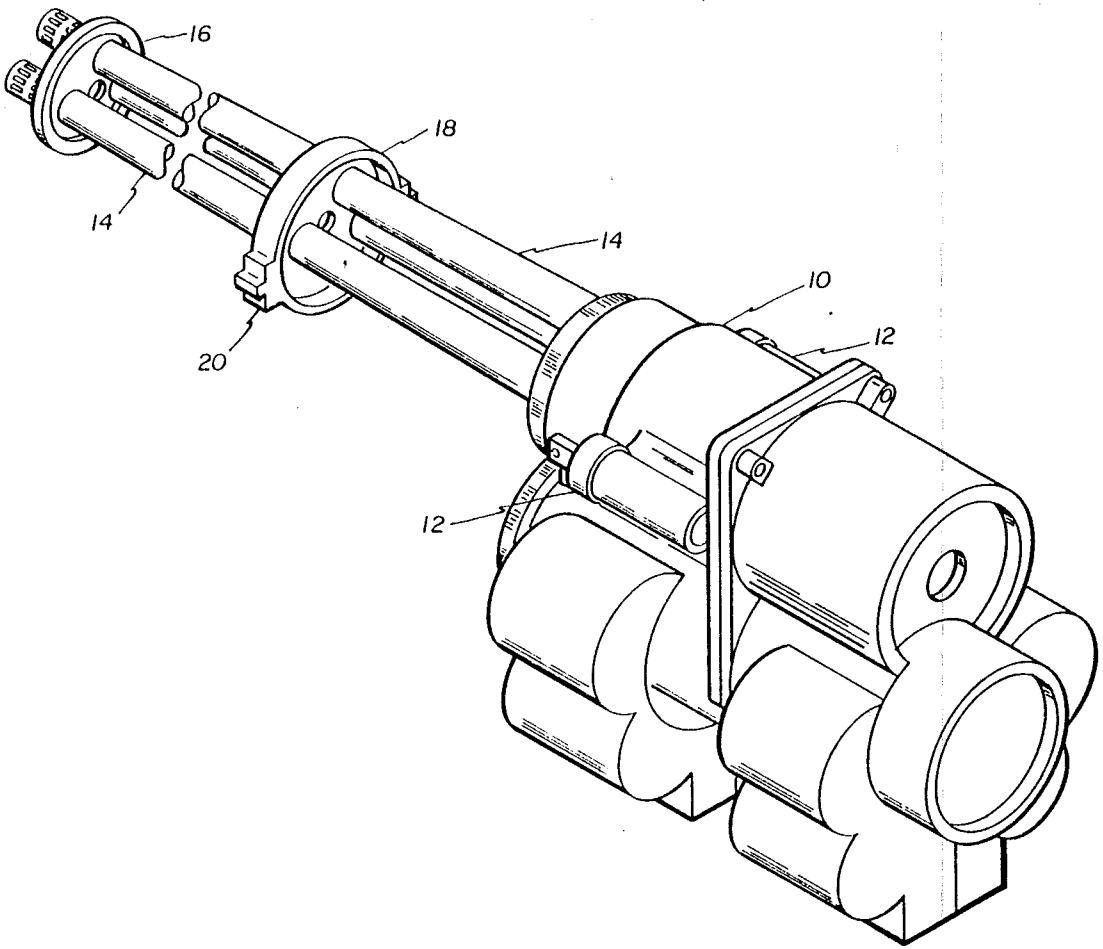
FIG. 1 is a perspective view of a Gatling type gun embodying this invention.

The Gatling gun shown in FIG. 1 includes a stationary housing 10 which is mounted, as to a vehicle, by a pair of recoil adapters 12. A plurality of gun barrels 14, hereshown as three, are fixed in an annular row to a rotor (not visible) which is journaled for rotation within the housing. The barrels are held in a cluster by a forward barrel clamp 16, a mid-barrel clamp 18 is journaled for rotation in a slide mount 20. A similar type of gun mount is shown in U.S. Pat. No. 4,345,504 issued to R. G. Kirkpatrick et al on Aug. 24, 1982. The gun may be of any suitable Gatling type, as shown, for example in U.S. Pat. No. 4,314,501 issued to R. G. Kirkpatrick on Feb. 9, 1982, or in U.S. Pat. No. 4,216,698 issued to R. E. Chiabrandy on Aug. 12, 1980, or in U.S. Pat. No. 3,760,683 issued to J. M. Seemann on Sept. 25, 1973.

Figure 2:
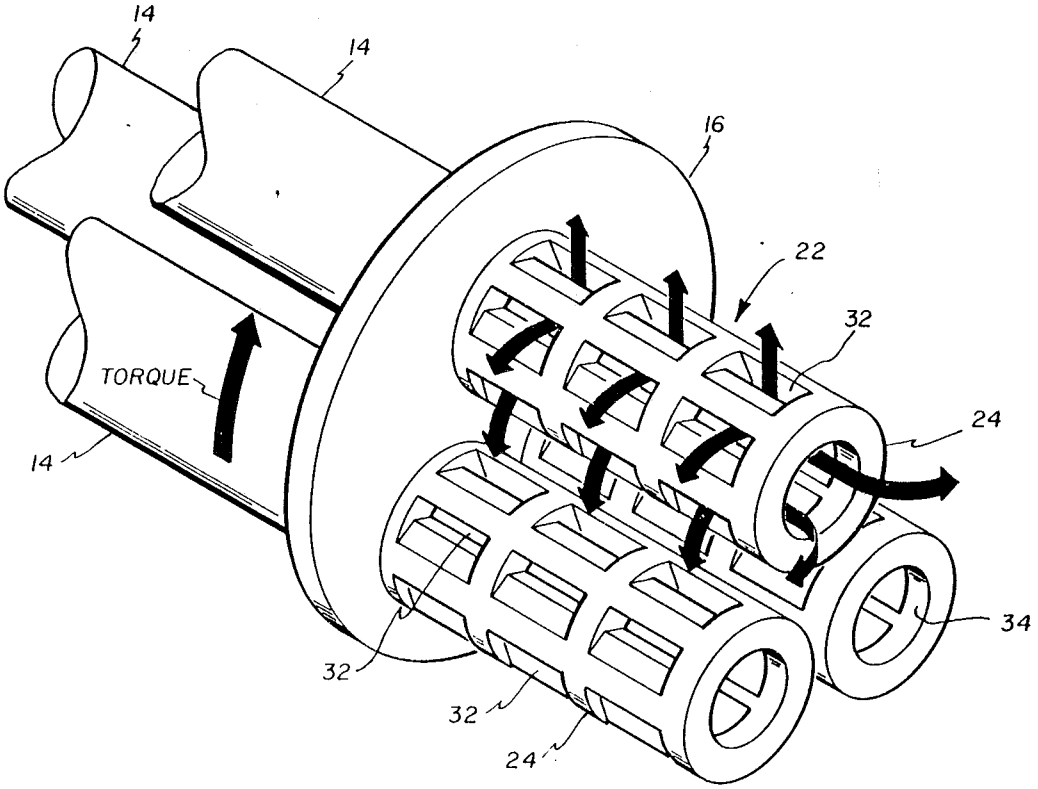
FIG. 2 is a detail perspective view of the muzzle brake torque assist device of FIG. 1.

As shown in FIG. 2, the forward barrel clamp 16 serves as part of the muzzle brake torque assist device 22. The device 22 includes a plurality of barrel extension tubes 24, serving as torque tubes, here shown as three, one for each barrel, that are fixed to the clamp 16. Each extension tube has a plurality of radial slots 32 cut through its tube wall, shown as six in FIG. 3, to provide a like plurality of torque tube vanes 28 each having a face 30. However, as shown in FIG. 2, to provide rigidity to the tube structure, each slot is actually formed as a longitudinally extending set of ports 32, each set here shown as three in number.

The muzzle device 22 deflects a large percentage of the muzzle gas from axial flow to radial flow by impact with the aft facing surfaces formed by the plurality of slots. This change in direction of the high-velocity muzzle gas provides a forward thrust on the barrel cluster, to which the muzzle device is attached, which partially counteracts the recoil force. It may be noted that when firing a round of ammunition having a large amount of propellant, the contribution of the propellant gas to the total recoil impulse is nearly half the total. Thus, deflecting the gas radially reduces the average recoil force as well as the peak recoil force.

Figure 3:
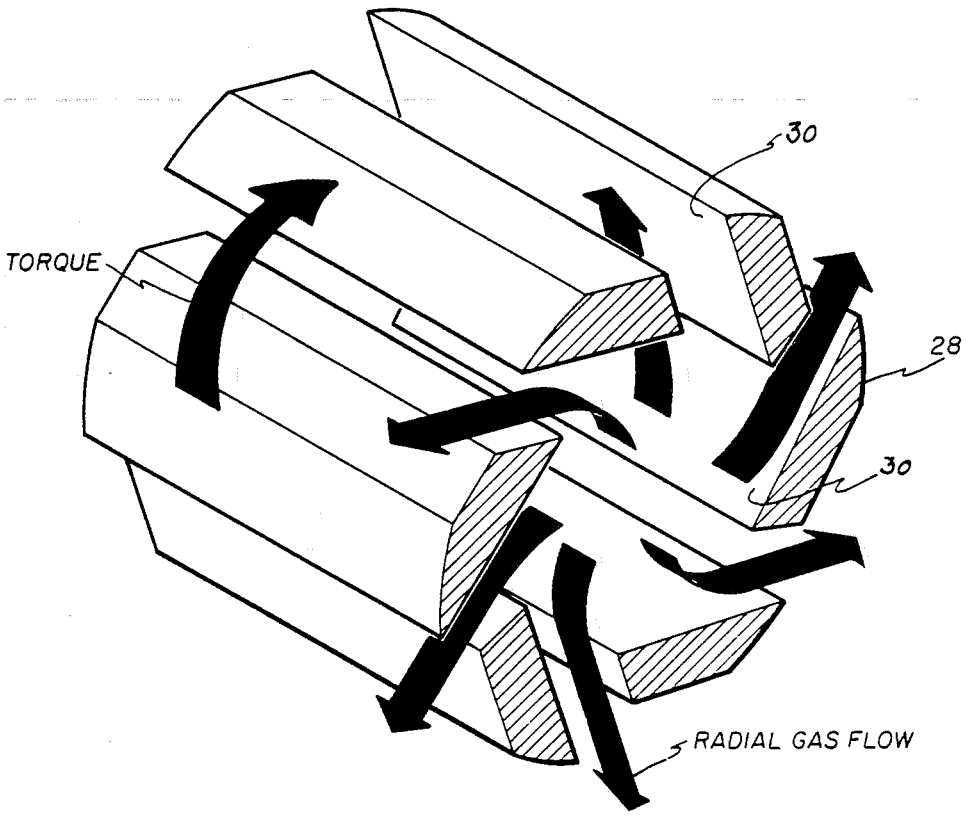
FIG. 3 is a detail perspective cutaway view of the device of FIG. 2.

The radially directed flow of muzzle gas through the ports 32 against the faces 30 of the vanes 28 imparts a torque about the longitudinal axis of the respective gun barrel, shown in FIG. 3 as counter clock-wise when viewed from the rear. These torques about the gun barrel axes resolve into a torque about the longitudinal axis of the gun barrel cluster which is the axis of rotation of the rotor, shown in FIG. 2 as counter clockwise.

Figure 5:
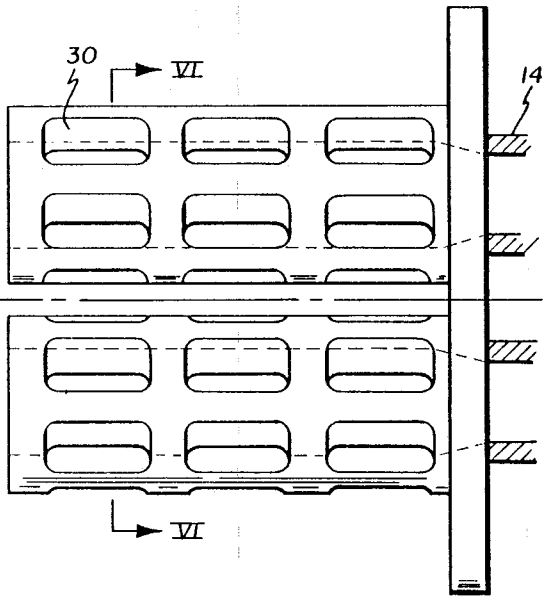
FIG. 5 is a side elevation of the device of FIG. 2.
Figure 6:
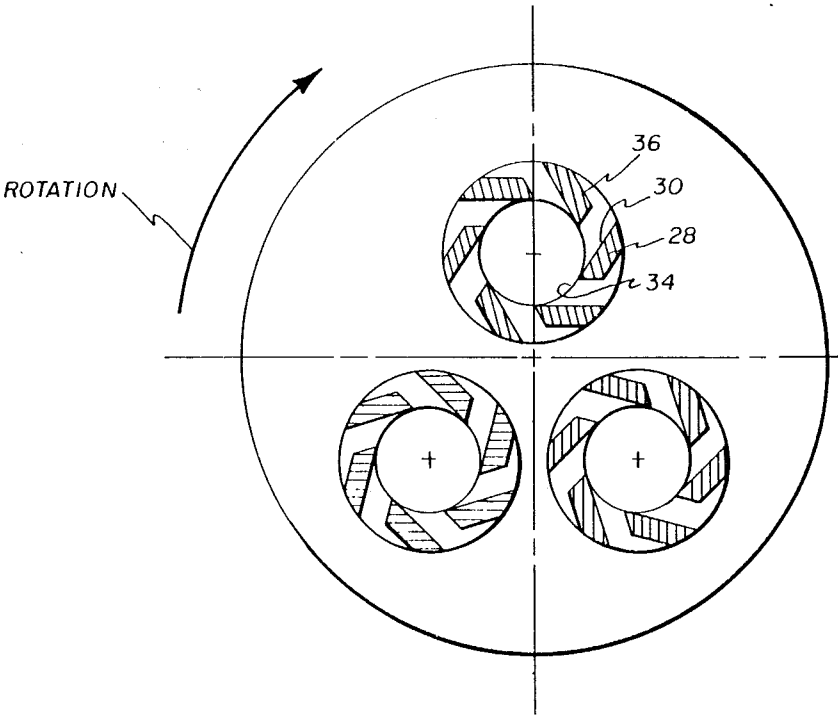
FIG. 6 is a front cross-section taken along the plane VI—VI of FIG. 5.

As shown in FIG. 5, the face 30 of the vane 28 is a plane which is tangential to the inner bore 34 of the torque tube.

The outlet cross-sectional area of the port 32 is enlarged by removing part of the back wall at 36.

The outlets of the ports 32 are radially within the radius of the nonrotating slide mount 20, within which the mid-barrel clamp 18 rotates. Since gases flow equally through all slots of the extension tube there is no lateral load which must be reacted by the mount 20 to react the forces generated at the outlets. The radius of the housing 10 is similarly greater than the radius of the outlets.

While the face 30 has been shown as tangential to the inner bore 34, it will be appreciated that the face may be at any angle that will deflect the generally radial flow of gas into a more tangential flow and absorb energy nonsymmetrically from such deflection to generate a torque. As a limiting value, if the port 32 is cut on a true radius to the longitudinal axis of the tube, such energy as will be absorbed, will be absorbed symmetrically, and no torque will be generated. The face 30 may also be formed concave, rather than flat, as shown.

Figure 4:
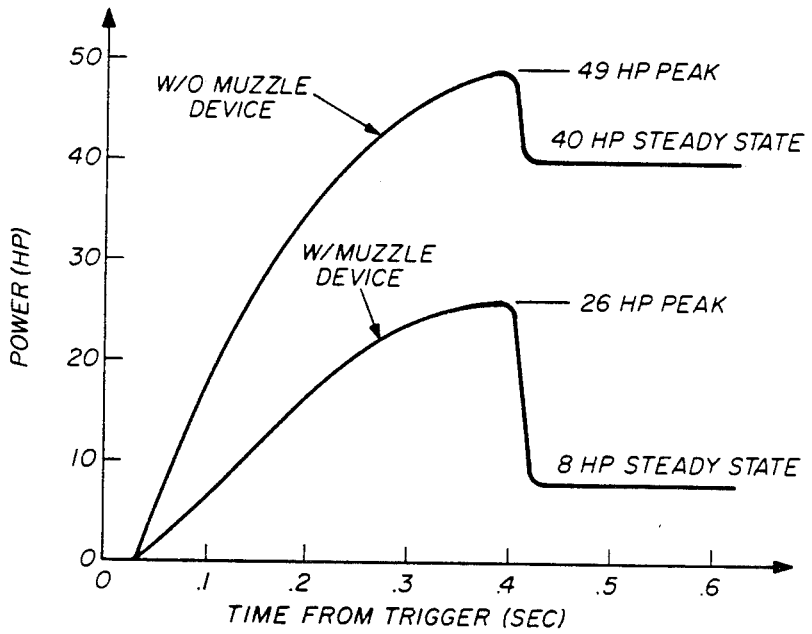
FIG. 4 is graph showing the power provided by the device of FIG. 2 for a typical Gatling gun installation.

A round of ammunition having a projectile mass of 1600 grains and a propellant mass of 120 grams can generate an impulse per shot of approximately 55 lb.-sec. The muzzle device can reduce this impulse by 30% to 40 lb-sec. per round, and generate 32 H.P. The gun system power requirement (without the muzzle device) as a function of time during system acceleration, is shown in the upper curve of FIG. 4. Note that the required power rises to a peak of 49 H.P. and then declines to 40 H.P. steady state. The gun system power requirement (with the muzzle device) as a function of time during system acceleration, as shown in lower curve of FIG. 4. Note that the required power rises to a peak of merely 26 H.P. and then declines to 8 H.P. steady state. This reduction of the external power requirement allows a broad spectrum of potential power sources to drive the gun: electric, engine bleed air, self-contained pneumatic and hydraulic.

I claim:

1. A muzzle brake torque assist device for a Gatling type gun having a cluster of a plurality of gun barrels disposed in an annular row and journaled for rotation within a nonrotating structure about a longitudinal axis disposed through the center of said row, comprising:

a like plurality of extension tubes, each fixed at the muzzle end of, and having a longitudinal bore in longitudinal alignment with, a respective gun barrel;

each of said tubes having a plurality of gas ports disposed in a uniformly spaced apart annular row, each port passing from said bore through the wall of said tube and having a respective vane surface adapted to be impacted by the flow of gun gas from the respective gun barrel flowing into the tube and out through said port, whereby said vane surface absorbs energy from the flow of gun gas through said port to generate a torque in the respective tube about the longitudinal axis of said respective tube.

2. A device according to claim 1 wherein:

said nonrotating structure has a minimum inner radius which is greater than the maximum radius of said gas ports.

3. A device according to claim 1 wherein:

each of said vane surfaces is formed along a plane which is substantially tangential to the inner wall of said bore of said tube.

4. A device according to claim 3 wherein:

said port has an inlet having a first cross-sectional area opening onto said bore of said tube and an outlet, having a second cross-section area, opening onto the exterior of said tube, said second area being greater than said first area.

5. A process of providing torque to a cluster of a plurality of gun barrels disposed in an annual row in a Gatling type gun, each barrel having a respective longitudinal axis and the cluster having a longitudinal axis of rotation, comprising:

providing a respective radial centrifugal flow, of the gun gas flowing through each respective gun barrel, adjacent its muzzle end;

deflecting said respective radial centrifugal flow of gun gas towards a tangential flow and absorbing energy nonsymmetrically from such deflection to generate a respective torque about the respective longitudinal axis of the gun barrel;

resolving the respective torques about the respective longitudinal axes of the gun barrels into a torque about the longitudinal axis of the cluster of gun barrels.

6. A process according to claim 5 wherein:

said provision of respective radial—centrifugal flows of gun gas is symmetrical about the respective longitudinal axis of the respective gun barrel and thereby avoids developing a lateral load on the respective gun barrel.

* * * * *